US010611593B2

(12) United States Patent
Lam et al.

(10) Patent No.: US 10,611,593 B2
(45) Date of Patent: Apr. 7, 2020

(54) SOFT PACK TAPE APPLICATOR

(71) Applicant: LAMUS ENTERPRISES INC., Vancouver (CA)

(72) Inventors: Joe Augustine S. T. Lam, Vancouver (CA); Jason Cheng, Burnaby (CA)

(73) Assignee: LAMUS ENTERPRISES INC., Vancoucer, BC (CA)

( * ) Notice: Subject to any disclaimer, the term of this patent is extended or adjusted under 35 U.S.C. 154(b) by 0 days.

(21) Appl. No.: 15/981,492

(22) Filed: May 16, 2018

(65) Prior Publication Data

US 2019/0352120 A1 Nov. 21, 2019

(51) Int. Cl.
*B65H 35/00* (2006.01)
*B65B 51/06* (2006.01)

(52) U.S. Cl.
CPC ..... *B65H 35/0013* (2013.01); *B65B 51/067* (2013.01); *B65H 35/0086* (2013.01)

(58) Field of Classification Search
CPC ..... B65H 2801/81; B65H 35/0006; B65H 35/0013; B65H 35/04; Y10T 156/12; Y10T 156/17; B65B 51/00; B65B 51/06; B65B 51/067
See application file for complete search history.

(56) References Cited

U.S. PATENT DOCUMENTS

| | | | |
|---|---|---|---|
| 5,338,384 | A | 8/1994 | Reichert |
| 8,176,959 | B2 | 5/2012 | Lam |
| 9,061,857 | B2 | 6/2015 | Johnson |
| 9,517,914 | B2 | 12/2016 | Menta et al. |
| 9,630,796 | B2 | 4/2017 | Menta et al. |
| 2013/0174962 | A1 | 7/2013 | Fasse et al. |
| 2018/0022492 | A1 | 1/2018 | Takahashi et al. |

FOREIGN PATENT DOCUMENTS

| | | |
|---|---|---|
| CN | 102092497 | 6/2011 |
| DE | 3820060 | 12/1989 |
| JP | 4265745 | 5/2009 |

*Primary Examiner* — Mark A Osele
*Assistant Examiner* — Christopher C Caillouet

(57) ABSTRACT

A tape applicator for applying tape to seal a case is disclosed wherein the pressure applied to the top of the case may be significantly reduced by activating an actuator at the appropriate time to lift the application mechanism or assembly and the cut-off mechanism away from the case being sealed.

18 Claims, 6 Drawing Sheets

SOFT PACK TAPE APPLICATOR

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable.

FIELD OF INVENTION

The present invention relates a tape applicator or tape head more particularly to a tape applicator for applying tape to seal a soft case (easier to bend or damage) or carton by reducing pressure applied to the case or carton being sealed at the appropriate time and/or one that can be easily transformed to a conventional tape head for taping or sealing a case or carton.

BACKGROUND OF THE PRESENT INVENTION

Conventional tape heads as currently used to tape or seal cases or cartons are designed to apply a reasonably strong force on the tape to better ensure a strong bond between the tape and the case or carton. Conventionally most cartons that are taped to seal them on case sealing machines are made from corrugated paperboard that is generally a laminate of two opposed surface layers or liners with a corrugated layer sandwiched therebetween and adhered to each liner which provides a material of sufficient strength for the intended use. Even when the case or carton is made of such material and is not properly or fully filled care must be exercised to ensure the pressure applied during sealing does not unduly deform the closure flaps of the case being sealed as the tape is being applied. This problem of deforming the case or flaps is exacerbated when the case is made of flimsier material and particularly when such a case or carton is not properly filled which normally results in what is referred to as a soft case or carton of the like.

Distortion of the carton closure flaps is a problem that on-line shopping and resulting shipping has magnified significantly and one of was proposed to help solve tis problem requires reduction of the pressure applied to the closure flaps of the case or carton during the taping operation.

Signode U.S. Pat. Nos. 9,517,914 and 9,630,796 provide examples of a device specifically designed to try to overcome this problem and uses a pair of pneumatic cylinders one to reduce pressure applied against the top (as opposed to the ends) of the carton or case to which a sealing tape is being applied by the tape application rollers and a second to reduce pressure applied by the cut-off mechanism of the tape applicator or tape head. The earlier of these 2 patent relates specifically to reducing the pressure applied to by the wipe down roller and the later one to reducing the pressure applied by the cut-off mechanism. As indicated each uses a dedicated pressure cylinder to reduce pressure being applied.

US application 2013/174962 uses a sensor to sense the position of a carton to which a sealing tape is being applied and activate a pressure cylinder to raise and lower the tape applying and pressing rolls to apply different pressures to the tape and thereby the to the carton.

U.S. Pat. No. 9,061,857 increases the spring tension in stages to reduce the forces applied to the leading face of the case being taped with the increased tension being generated using a bar that presses against the case.

Chinese patent CN102092497 uses a pressure cylinder to position the application and pressure roller of the tape applicator. Japanese patent JP4265745 connects a cylinder to the trailing or wipe down arm and another cylinder connects to the cut-off mechanism each via a lost motion connection U.S. Pat. No. 5,338,384 uses a pressure cylinder to change the pressure applied to the rollers more particularly to increase the pressure to the wipe down roll when wiping the tape onto the trailing face of the carton.

US patent application 2018/022492 also uses a pressure cylinder to adjust the pressure applied to the case being sealed to apply less pressure to the top of the case.

It is also known that devices used to apply what are know as L-clips to seal the flaps by applying short lengths of tape to the flaps adjacent the opposed ends of the flaps so there is no tape application over a significant central portion of the flaps using a cylinder to direct the tape towards the knife to be cut, see, for example, U.S. Pat. No. 8,176,959 issued May 15, 2012 to Lam or German patent DE3820060 both of which manipulate the push bar connecting the front application roll and back wipe down roller to move them way from the box or case between the applications of the L-clips. These devices are not designed to reduce pressure on the case or carton rather the applicator roll is moved up to bring the tape towards the knife for cutting.

None of the reference found to-date teach a simplified system of the present invention wherein an actuator is used to increase the pressure applied to the carton or case by the wipe down roll and the cut-off mechanism at the appropriate times

BRIEF DESCRIPTION OF THE PRESENT INVENTION

It is an object of the present invention to provide a tape applicator or tape head to softly apply a tape to a soft carton; a carton with under-filled contents or a "Re-shipper" carton (i.e.: a reusable carton with no flap memory) over a significant portion of the length of the case or carton so that the tape application does not significantly distort the closure flaps of the case or carton being sealed by the tape and to a tape applicator that is easily transformed to apply normal or conventional tape applying forces during the taping operation.

Broadly the present invention relates to tape applicator, comprising a frame, a source of tape mounted on said frame, an front applicator assembly including a front applicator to apply a leading end of a tape from said source to a leading face of a carton moving relative to said tape applicator pivotably mounted on said frame on a first pivotal axis, a rear wipe down arm assembly including a rear wipe down roll to wipe a tape applied to said carton along a trailing face of said carton remote from said leading face pivotably mounted on said frame on a second pivotal axis parallel to said first pivotal axis, a push bar link interconnecting said application roll assembly and said wipe down assembly for movement together to form a tape applicator assembly, a cut-off mechanism mounted on said frame on a third pivotal axis parallel to said first and second pivotal axes and positioned between said first and second axes, a cam arm pivotably mounted to said frame on a cam arm axes parallel to said third axis, an applicator cam element and a cut-off cam element fixed to said cam arm, a cooperating applicator cam element connected to said tape applicator assembly and a cooperating cut-off cam element connected to said cut-off mechanism, an actuator interconnecting said cam arm and said frame, a control system controlling power to said actuator to move said cam arm. Preferably, said cooperating applicator cam is mounted on said push bar link.

Preferably, said control system includes a control cam positioned to sense said leading and trailing faces.

Preferably, said activator is a pneumatic pressure cylinder and said control system includes a control valve controlling flow of air to said cylinder Preferably, said activator is an electric solenoid and said control system includes an electric controller controlling power to said solenoid.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1A:
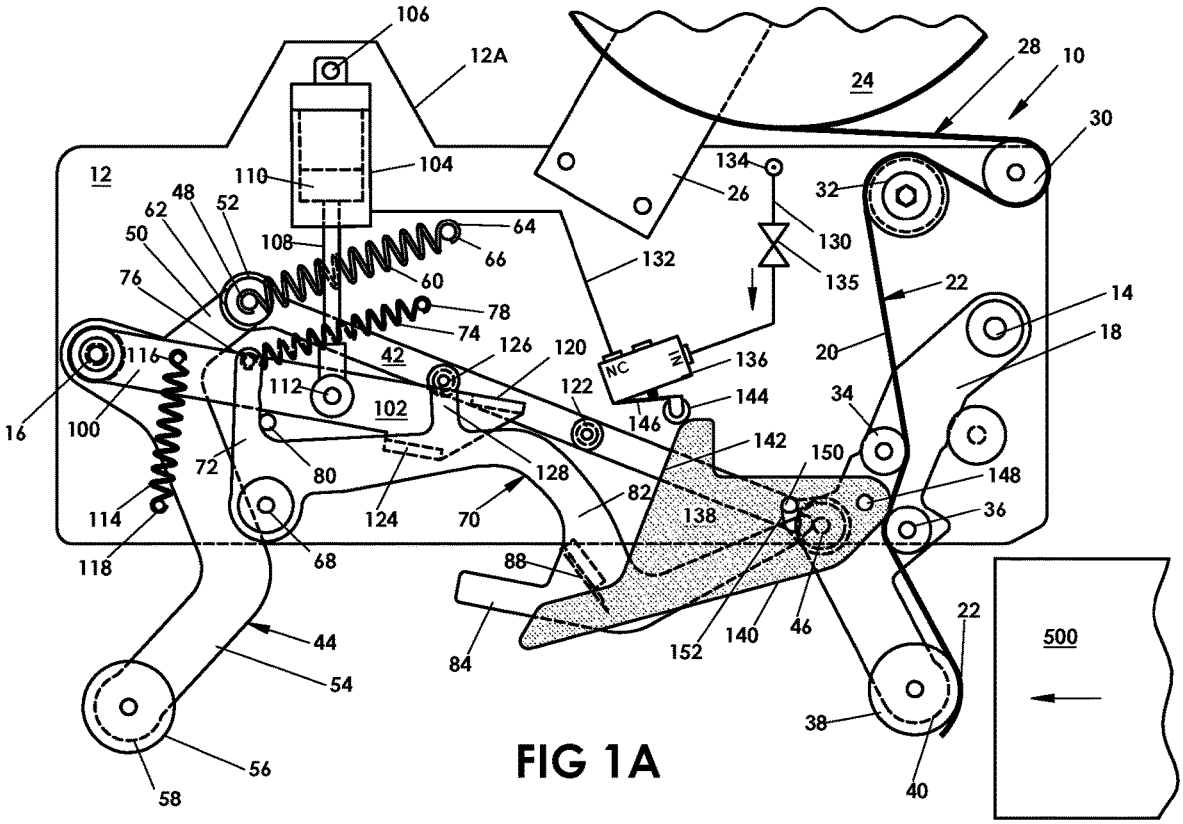
FIG. 1A is a side elevation with parts omitted to shown the main moving elements of the present invention in their initial position awaiting the arrival of a case or carton to be sealed.

The tape applicator or tape head 10 of the present invention has a frame 12 composed of a pair of opposed sides frame members 12A and 12B (see FIG. 1A) coupled together in fixed parallel relationship by transverse shafts or the like 14 and 16 as well as the transverse shaft 106 mounting the actuator in this embodiment a pneumatic pressure cylinder 104 as will be described below.

Figure 1B:
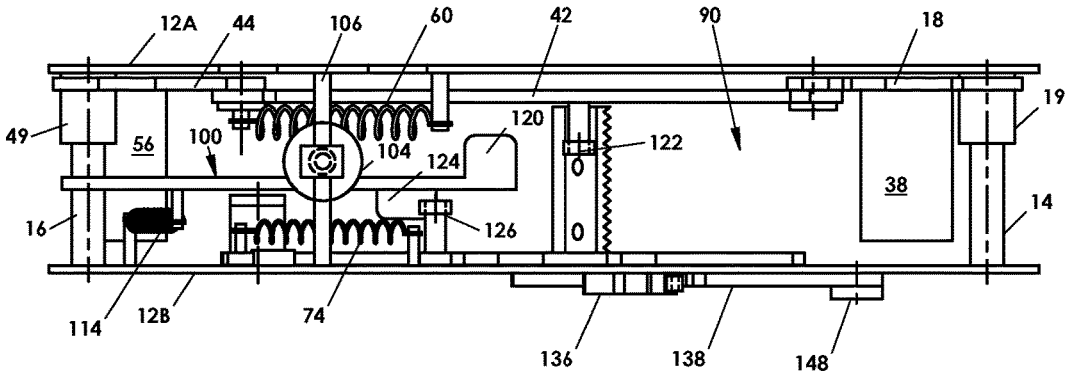
FIG. 1B is a plan view of the present invention showing the relative positions various element of the invention.

The shaft 14 pivotably mounts as indicated at 19 in FIG. 1B a front application arm 18 to which an adhesive tape 20 having and adhesive side 22 is fed as shown in FIG. 1, for example, from the tape roll 24 rotatably mounted on support arm 26 in the conventional manner. The tape 20 follows a tape path 28 over guide roll 30 and then one-way clutch roll 32 to guide roll 34 and 36 mounted on the arm 18 and onto the application roll 38 mounted on the arm 18 adjacent to a free end 40 thereof i.e. into a position to engage the adhesive side 22 thereof with a carton of case 500 to which the tape 20 is to be applied as it is moved passed the tape head 10.

A push bar connector link 42 extends between the application arm 18 and the wipe down arm or assembly 44 and is pivotably connected to the arm 18 as indicated at 46 and to the wipe down arm as indicated at 48.

The wipe down arm 44 is pivotably mounted as indicated at 49 in FIG. 1B on shaft 16 and has a biasing branch 50 extending in a first direction from one side of the shaft 16 or mounting 49 and the wipe down roll mounting branch 54 extending in a second direction form a second side of the shaft 16 or mounting 49. The pivotal connection 48 to the push bar link 42 is positioned adjacent to a free end 52 of the biasing branch 50 and a wipe down roll 56 adjacent to a free end 58 of the branch 54. An application biasing spring 60 is connected at one end 62 to the biasing arm 50 adjacent to the free end 52 thereof and at is other 64 end to the frame 12 as indicated 66.

The application arm 18 and its application roll 38 coupled to the wipe down arm 44 and its wipe down roll 56 via the pus bar link 42 combine to form the application mechanism or assembly.

Also, pivotably mounted as indicated at 68 on the frame 12 between the wipe down assembly 44 and the application arm 18 is a cut-off mechanism 70 which has a first arm 72 connected as indicated at 76 adjacent to its free end to a cut-off spring 74. The opposite end of the spring 74 is connected to the frame 12 as indicated at 78. The spring 74 biases the first arm 72 against a stop 80. A second arm 82 of the cut-off mechanism 70 extends in a second direction from the mounting 68 and terminates in a knife control cam element 84 and mounts a cut-off knife 88 adjacent to the cut-off knife cam element 84.

The device as described above is a conventional tape head currently in use in the industry. The additions and/or changes that are the substance of one embodiment of the invention that transforms the known tape head into a tape head having the option of reducing the pressure applied to the top of the carton or case by the application and wipe down rolls 38 and 56 and the cut-off mechanism 70 device with will now be described.

It will be noted that the arms or assemblies 18 and 44 are located adjacent to the frame member 12A and the cut-off mechanism 70 has its arms 72 and 82 adjacent to the opposite frame member 12B to provide an open space 90 therebetween (see FIG. 1A) that accommodates a camming mechanism 100.

The camming mechanism 100 includes a cam arm or lever 102 pivotably mounted on the shaft 16 spaced from each of the side frames 12*a* and 12B, in the illustrated arrangement essentially midway between the side frames 12A and 12B. An actuator in the form of a pneumatic pressure cylinder 104 in this embodiment is coupled between the cam arm or lever 102 and the frame 12. In the illustrated arrangement the actuator 104 is pivotably mounted to the frame 12 on a shaft 106 that extends between and interconnects the side frames 12A and 12B and the piston shaft 108 extending from the piston 110 of the pressure cylinder 104 is pivotably connected to the arm 102 as indicated at 112. A spring 114 is connected at one end 116 to the cam lever 102 and at its other end to the 118 to the frame 12 to bias the cam arm 102 toward the case 500 being sealed (downward in the illustration) i.e. to bias the pressure cylinder 104 to extended position as illustrated in FIG. 1A and move the piston 110 to the position shown when no air is applied to the cylinder 104.

An application cam 120 in the form of a plate projects from the arm 102 adjacent to its free end toward the side frame 12A and the push bar link 42 in position when activated to engage with the cooperating application cam 122 in the form of a cam roller 122 that is connected to the push bar link 42 and lift the push bar 42 and thereby the rolls 38 and 56 to reduce the pressure they can apply to the case or carton 500 (see FIGS. 2 and 3) as occurs when (air) pressure is applied to the cylinder 104 to retract the piston 110 as will be further described below.

A cut-off cam 124 in the form of a second plate projecting on the opposite side of the cam arm 102 than the cam plate 120 (I.e. toward the side frame 12B and the cut-off mechanism 70) and positioned between the pivotal mounting of the cam lever 102 on the shaft 16 and the cam plate 120 to when activated (pressure is applied to the cylinder 104 to retract the piston 110) engage with the cooperating cut-off cam 126 in the form of a roller mounted on an extending from the arm 82 of the cut-off mechanism 70. In the illustrated arrangement the cam 126 extends from an arm 128 that project from the arm 82 (see FIG. 1).

It will be apparent that both the application cam 120 and the cut-off cam 124 when not in active positions i.e. engaging with the cooperating cams 122 and 126 respectively, are positioned to allow movement of the push bar 44 and the cut-off mechanism 70. The allowable upwards movement can accommodate cases or carton 500 height variation and machine height adjustment variations. When in active positions as described below they restrict downwards movement towards the case 500. It will be apparent that if the tape head 10 is to apply tape to the bottom of a case or carton it will be inverted and up will be down.

In the embodiment of FIG. 1A air under pressure is delivered to the cylinder 104 via lines 130 and 132 from a source 134 and the flow is controlled by the control in the form of a control valve 136 which in turn is controlled by the pressure control cam 138 which in the FIGS. 1, 1B and 2 to 7 illustrations is mounted directly to the frame 12 of the tape head 10 while in other embodiments it may be mounted to the machine in which the tape head is to be mounted and used as will be described below.

The pressure control cam 138 has a case engaging cam surface 140 that senses the presence of the case or carton 500 and a control surface 142 that cooperates with a follower 144 that controls the position of lever 146 that in effect operates the valve 136 to direct flow to and from the cylinder 104.

When the camming system 100 is not the to be used the air from the source 134 need simply be turned off for example by means of a valve schematically at 135.

The pressure control cam 138 in the embodiment shown in FIGS. 1, 1B and 2 to 7, is pivotably mounted as indicated at 148 to the out-side of side frame 12B i.e. side of side frame 12B remote from side frame 12A in the illustrated arrangement. The movement of the pressure control cam 138 is limited by engagement of pin 150 projecting from frame 12 and the slot 152 in the cam 138.

Figure 1C:
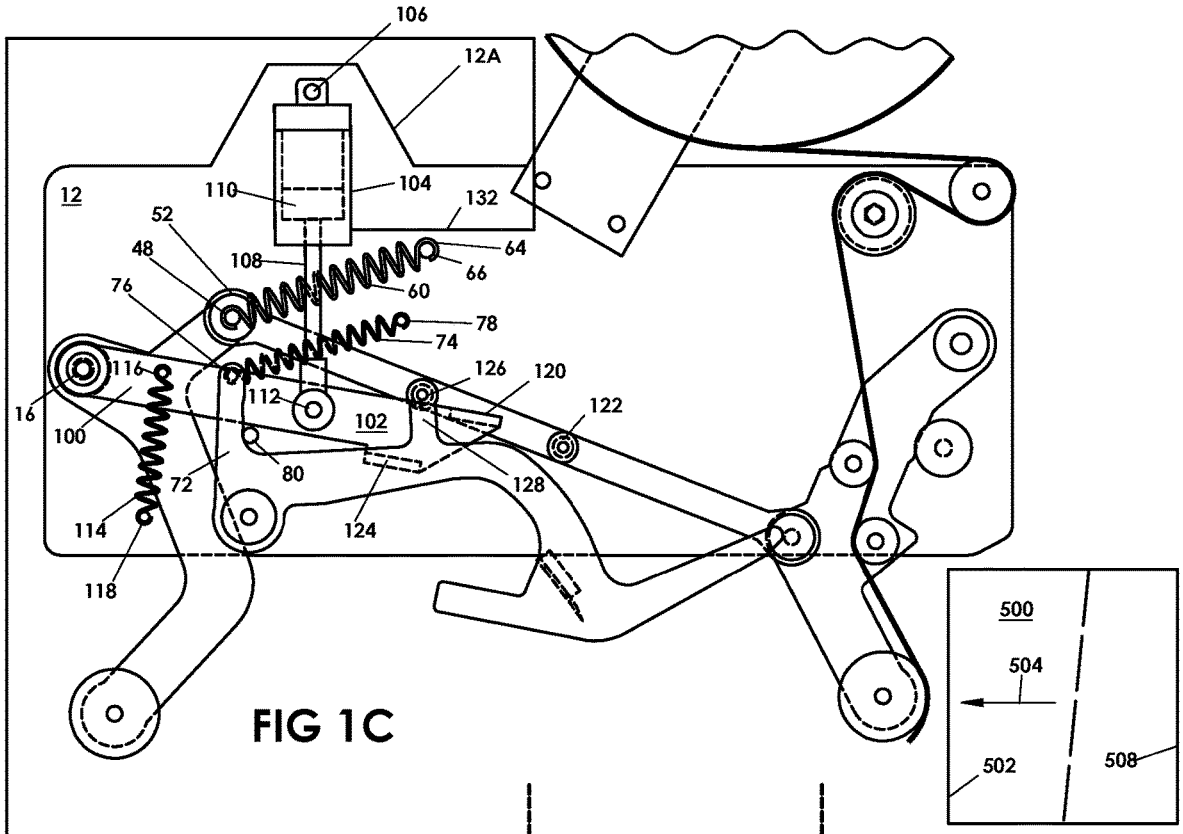
FIG. 1C is similar to FIG. 1A but the control cam has been replaced by sensors strategically mounted on the machine.

In FIG. 1C an alternative form of control for operating actuator (pressure cylinder 104 in FIG. 1C show an embodiment where a pair of sensors 617 and 618 (normally photosensor) each strategically mounted relative to the tape head or applicator 10 are used in place of the control cam 138. These sensors 617 and 618 trigger a controller which in turn operates the valve 404 which is essentially the same as valve 136 to control flow from the source 134C to the actuator in this case the pneumatic cylinder 104 or to vent air from the actuator 104 in the same manner and with essentially the same timing as flow to and from the actuator 104 is controlled by the cam 138.

Figure 1D:
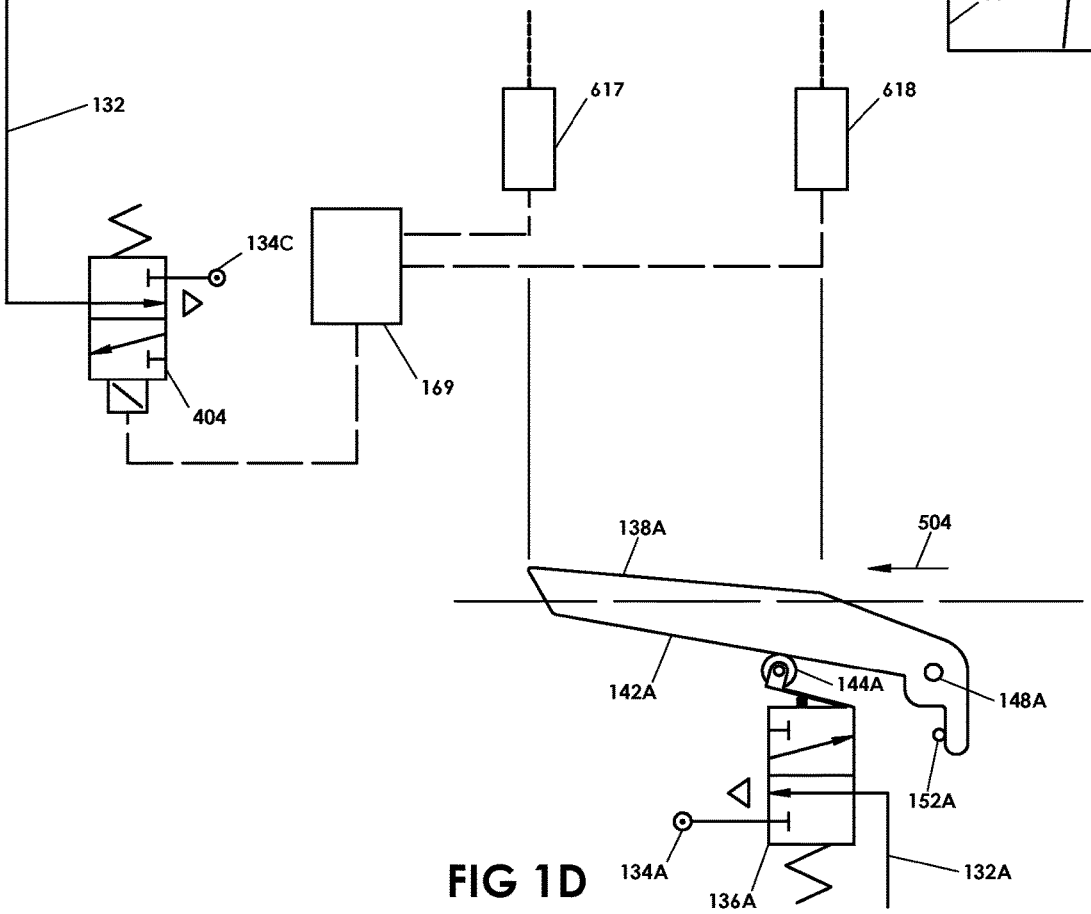
FIG. 1D show the control cam strategically mounted on the machine instead of on the tape head or applicator.

FIG. 1D uses a cam 138A which is essentially the same as cam 138 but is not mounted on the tape head 10 but is pivotably mounted as indicated at 148A on the machine (not shown) to which the tape head 10 is mounted and is positioned relative to the tape head 10 to engage the case or carton 500 either at the top or as illustrated at the bottom and operate the valve vale 136A the same as valve 136 is operated to control flow from the source 134A through line 132A which replaces line 132 to the actuator in this case the pneumatic cylinder 104 or to vent air from the actuator 104 in the same manner and with essentially the same timing as flow to and from the actuator 104 is controlled by the cam 138 as will be described with reference to FIGS. 2 through 7.

The cam 138A as illustrated in FIG. 1D is pivotably mounted as indicated at 148G and has a control cam surface 142A equivalent to the surface 142 of cam 138 and interacts with a cam 144A roller that operates the valve 123A in the same manner as the valve 132 is operated. In the illustrated arrangement the roller 144A and its mounting biases the cam 132A to it sensing position shown i.e. engaging the stop 152A as shown.

Figure 1E:
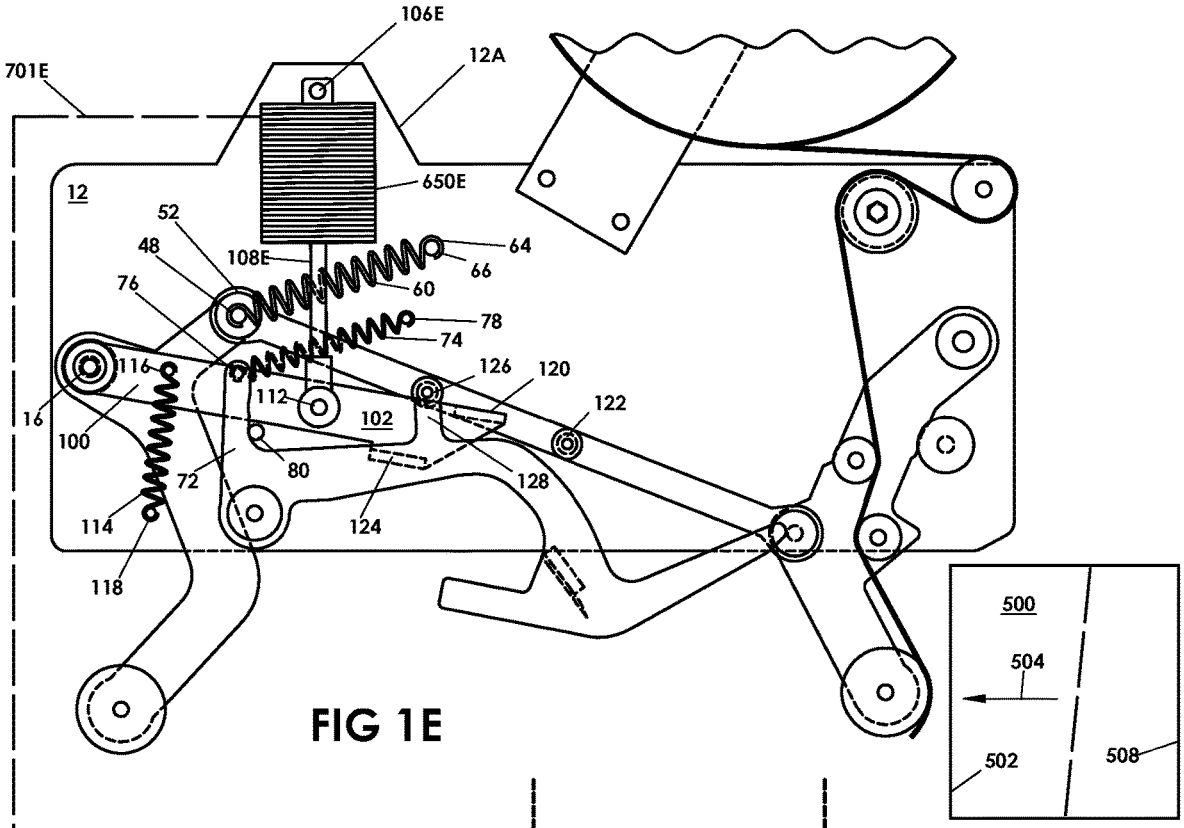
FIG. 1E is a view similar to FIG. 1C but with the pneumatic actuator replaced by an electrical actuator or solenoid actuator.

FIG. 1E is essentially the same as FIG. 1C with the exception instead of being pneumatic the system has been converted to an electrical system. The pneumatic pressure cylinder or actuator 104 is replaced with an electrical actuator 650E or solenoid having a reciprocal armature or piston 108E equivalent to the piston 108 that connects to the cam arm 102 the actuator 650E. The actuator 650E is mounted on the frame 12 on the shaft 106E in the same manner as the actuator 104 of FIG. 1A is mounted to the frame 12.

Control of the actuator 650E obviously must be an electrical control which as illustrated employs an electric controller 169F that controls the application of power via line 701E to the actuator 650E based on the triggering of the sensors 617F and 618F.

Figure 1F:
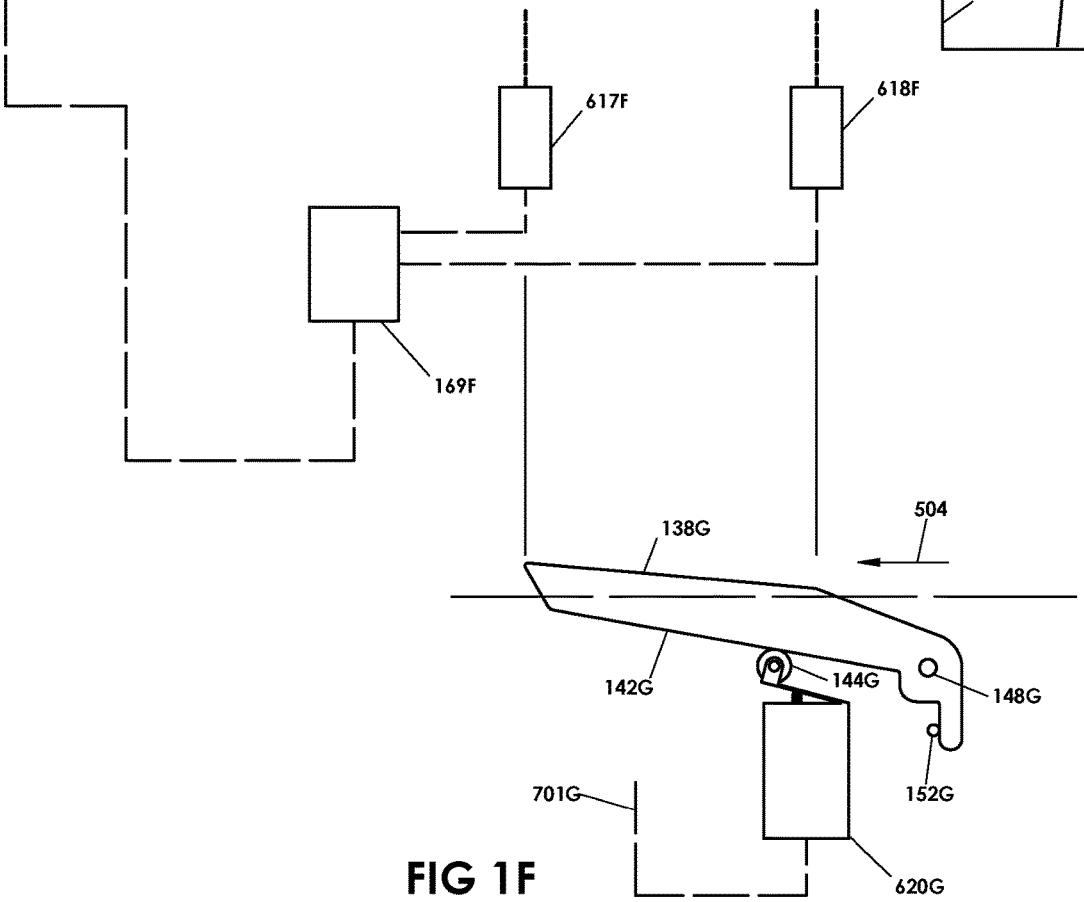
FIG. 1F is a view similar to FIG. 1D showing a control cam actuating a limit switch to control the solenoid.

FIG. 1F simply illustrates that the cam 138 G which functions the same as the cams 138 and 138A may be used to control power to the actuator 650E via power line 701G to the actuator 650E. The elements of cam 138G re he same as those of cam 138A and are designated by the same numerals but combined with the letter G instead of A.

It will be apparent a cam equivalent to cam 138 and mounted on the tape head as is cam 138 in FIG. 1A may also be used with the electrical actuator by substituting as required electrical controllers and switches for the valves, etc.

In FIGS. 11C and 1F vertical lines are extend to the sensors of 617, 617F and 618, 618F simply to indicate the activating locations are the same relate to the tape head 10 regardless of whether electrical or cam sensors are used (obviously this applies to the cam sensors of the cam 138 mounted on the frame 12

For the purposes of the present invention the term control system is intended to describe the control devices that control the flow of power to the activator whether it be pneumatic of electrical together with the cam or sensors that activate the control devices at the appropriate times during the cycle of apply the tape to the case or carton 50 as will be described below for the FIG. 1A embodiment.

The operation of the invention will be described using the FIG. 1A embodiment but as will be apparent will apply to any of the variations as shown in FIG. 1C to 1E inclusive.

Figure 2:
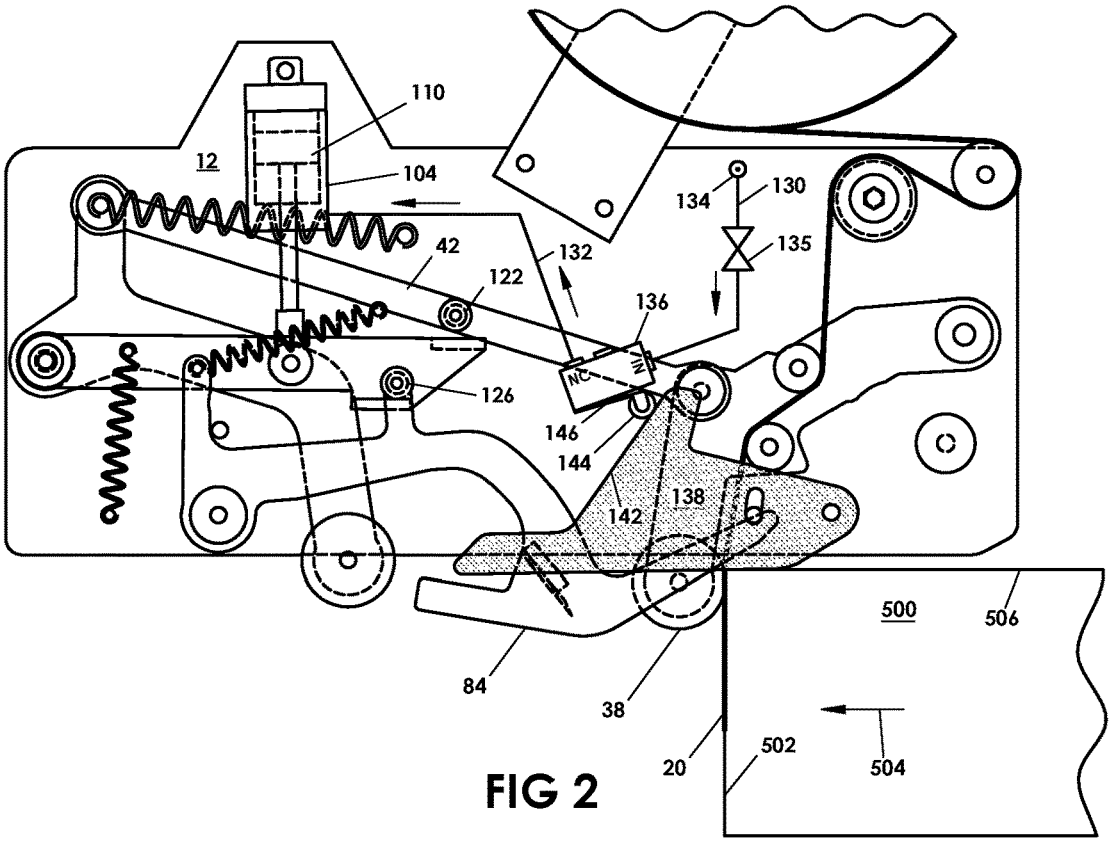
FIG. 2 is a view similar to FIG. 1A with the case or carton to be sealed having the tape applied to the leading end or face thereof and with the pressure control cam moved to relieve pressure applied to the cut-off mechanism and wipe down.

FIGS. 2 to 7 inclusive shown the sequence of operations using the FIG. 1A embodiment as the example. FIG. 2 shown the application roll 38 in contact with the leading face 502 of the case or carton 500 that is moving in the direction indicated by the arrow 504 to apply the tape 20 to the leading face in the normal manner. The pressure control cam 138 has engaged with the case 500 and is beginning to slide along the top surface 506 of the closed case or carton 500 causing the roller 144 to move along the cam surface 142 and move the lever 146 to open the valve 136 and have air flow to the cylinder 104 and move the piston 110 to the end of cylinder remote from the case 500 and thereby move the arm 100 toward its activated position lifting the application and wipe down rollers 38, 56 respectively on their respective arms 18 and 44 as well as the cut off mechanism 70 away from the case 500 to reduce pressure applied to the case. The cams 120 and 122 are engaged as are the cams 124 and 126 to so move the push bar 42 add the cut off mechanism 70.

Obviously, the roller cam 122 and cam plate 120 must be relatively positioned to engage when the case is in position shown in FIG. 2 with air being applied to the cylinder 104 as do the roller cam 126 and plate cam 124. Obviously, the positions of these cooperating cams may be varied within limits and still perform their required functions.

Figure 3:
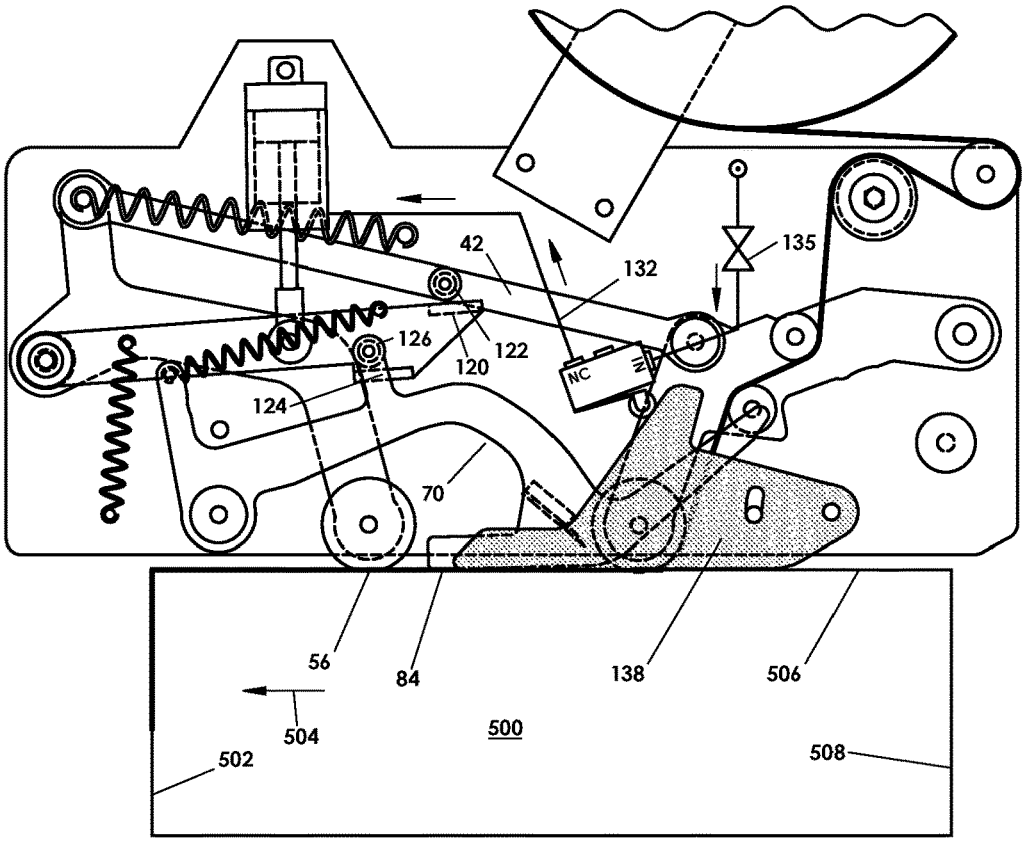
FIG. 3 is a view similar to FIG. 1A with the case or carton to be sealed having with the tape applied along o the top i.e. to what is normally designated as the major closure flap to seal the top of the case or carton using reduced application pressure and with the pressure applied by the cut-off mechanism reduced.

As the case 500 travels to the FIG. 3 position the cut-off cam 84 bears against the top or closed surface 506 of the case or carton 500 to further lift the cut off mechanism 70 and the rolls 56 and 38 however the pressure required to do so and thus the pressure applied to the case 500 is significantly less than normally would be required since the application assembly (18, 44 and 42) and cut of mechanism 70 have both been moved away from the case 500 with the cams 120 and 124 restricting downwards movement of cams 122 and 126, preventing both rolls 38, 56 and the cutting cam element 84 applying pressure that is likely to cause damage to the top surface of the carton 506.

Figure 4:
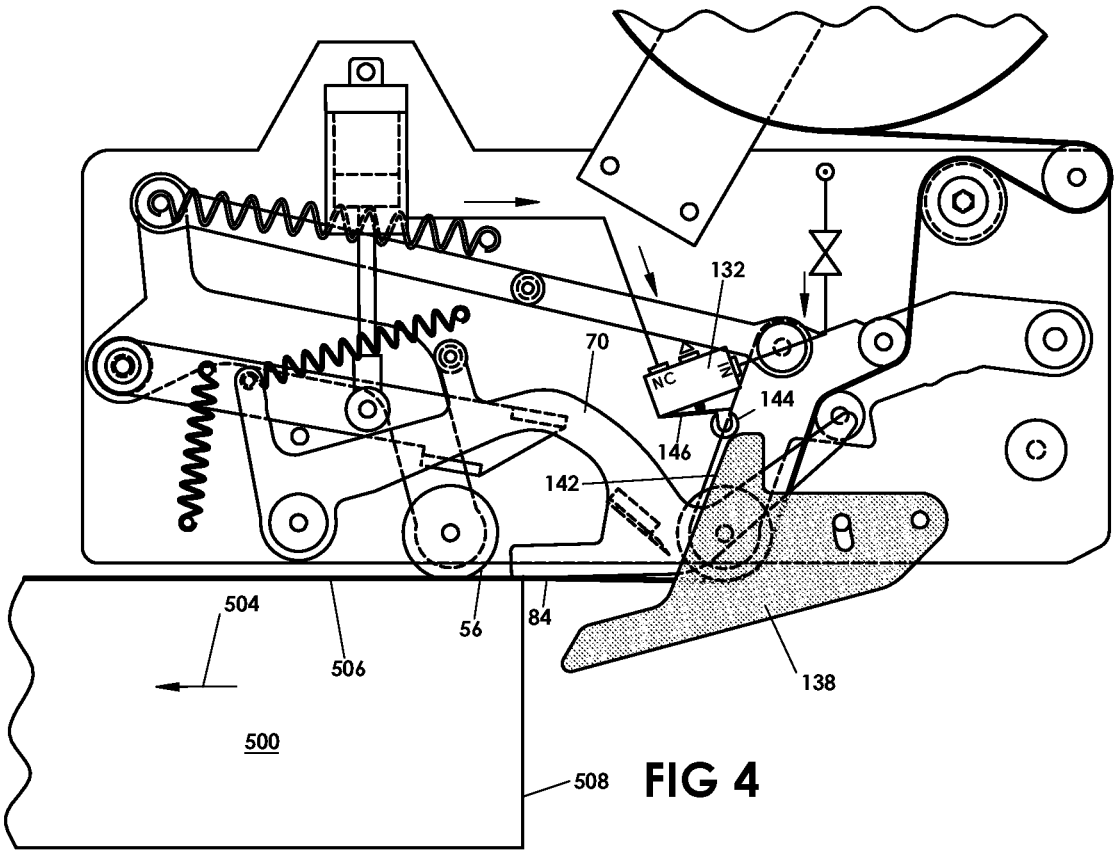
FIG. 4 is a view similar to FIG. 1A with the case or carton with the tape applied to the leading end and top thereof and pressure control cam positioned to permit exhausting of gas from the actuator and increase pressure on the cut-off mechanism and wipe down roll.
Figure 5:
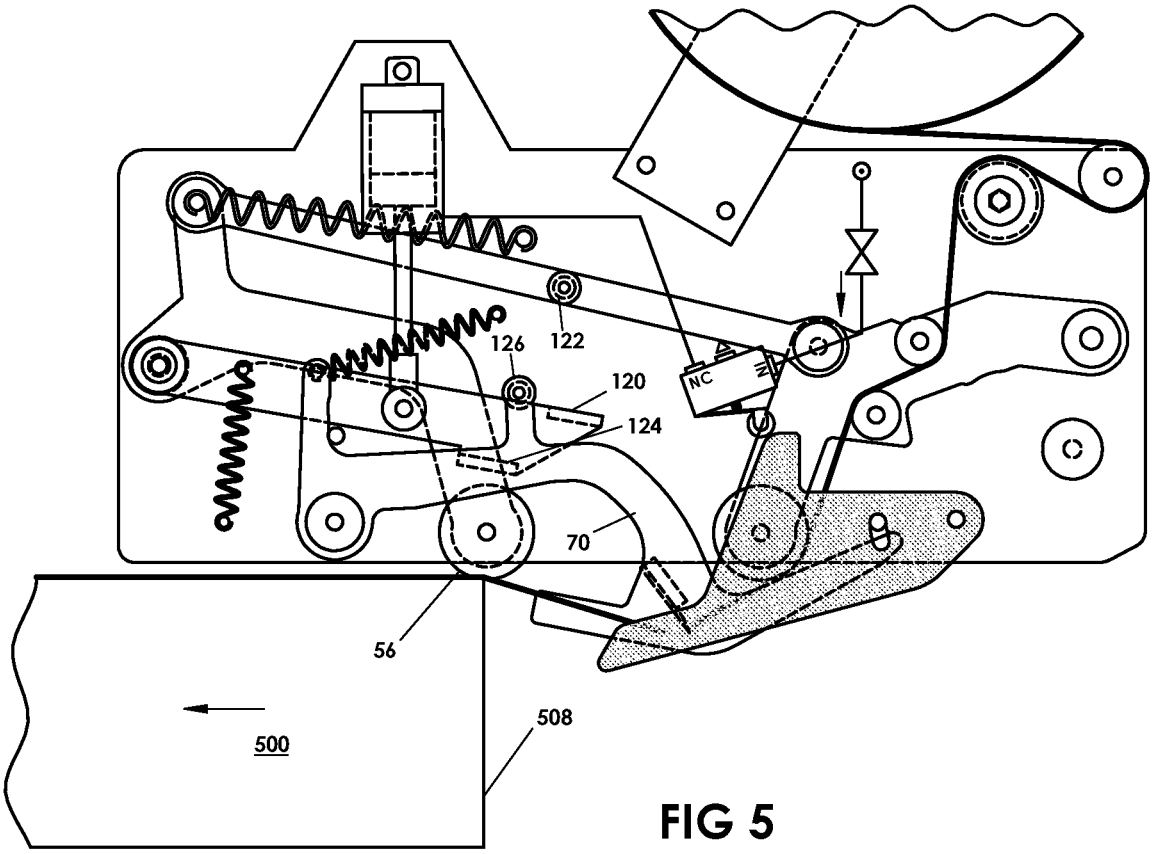
FIG. 5 is similar to FIG. 4 with the cut-off cam just clearing the trailing end of the case to cut the tape.
Figure 6:
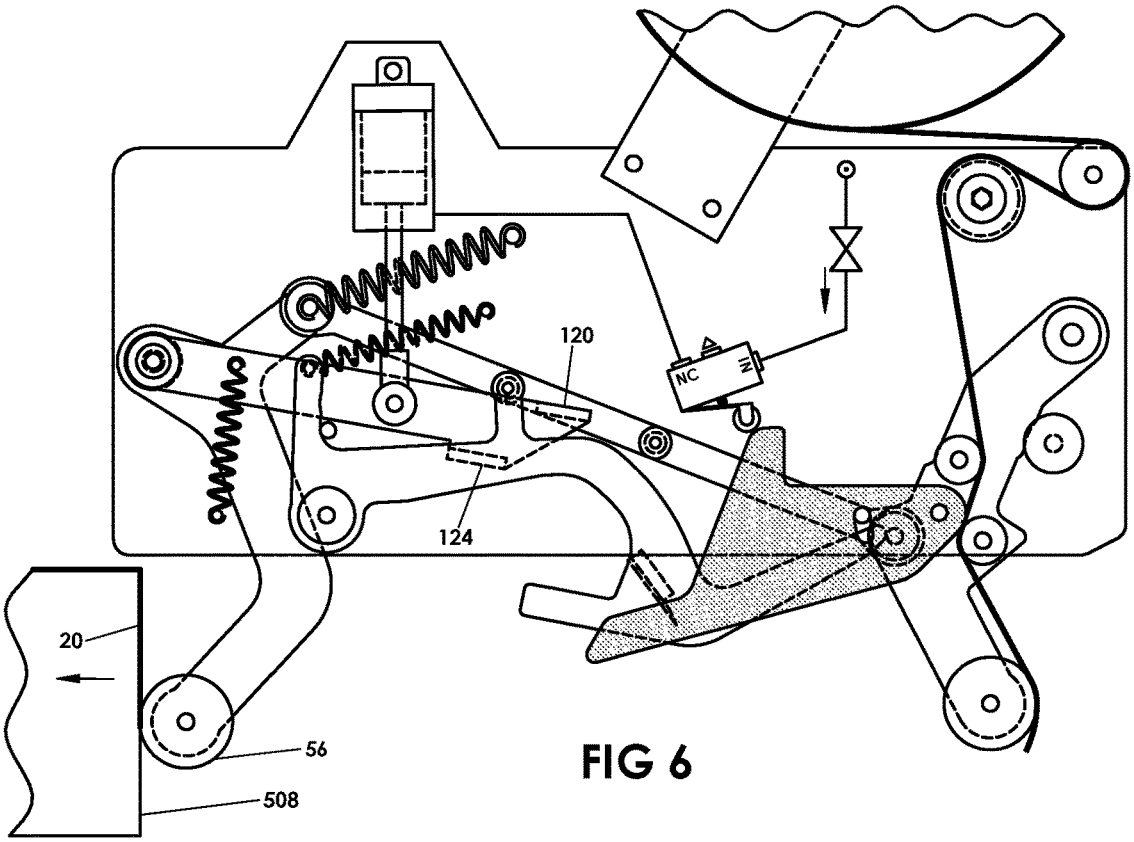
FIG. 6 shows the wipe-down roll having completing the application of tape to the trailing face of the case.

When the case 500 reaches the position of FIG. 4 the cam 138 has cleared the case 500 and moved so that the cam roll 144 moves along the cam surface 142 to move the lever 146 and close the valve 136 so no air flows from the source 134 and the cylinder 104 is vented thereby applying full spring pressure to the cut-off mechanism 70 and the application assembly (18, 44 and 42) particularly wipe down roll 56. The cut-off cam 84 in FIG. 4 is about to but has not yet cleared the rear or trailing end 508 case 500 so while the full force of spring 74 is available the cut-off mechanism is not quite triggered, however immediately thereafter the case 500 reaches the position shown in FIG. 5 (passes the trailing end 508) which releases the cut-off mechanism 70 to cut the tape 20 as shown. Next as shown in FIG. 6 the wipe down roll 56 clears the top 506 of the case 500 and moves down the trailing face 508 to secure the end of the tape 20 to the trailing face 508 in the normal manner.

Figure 7:
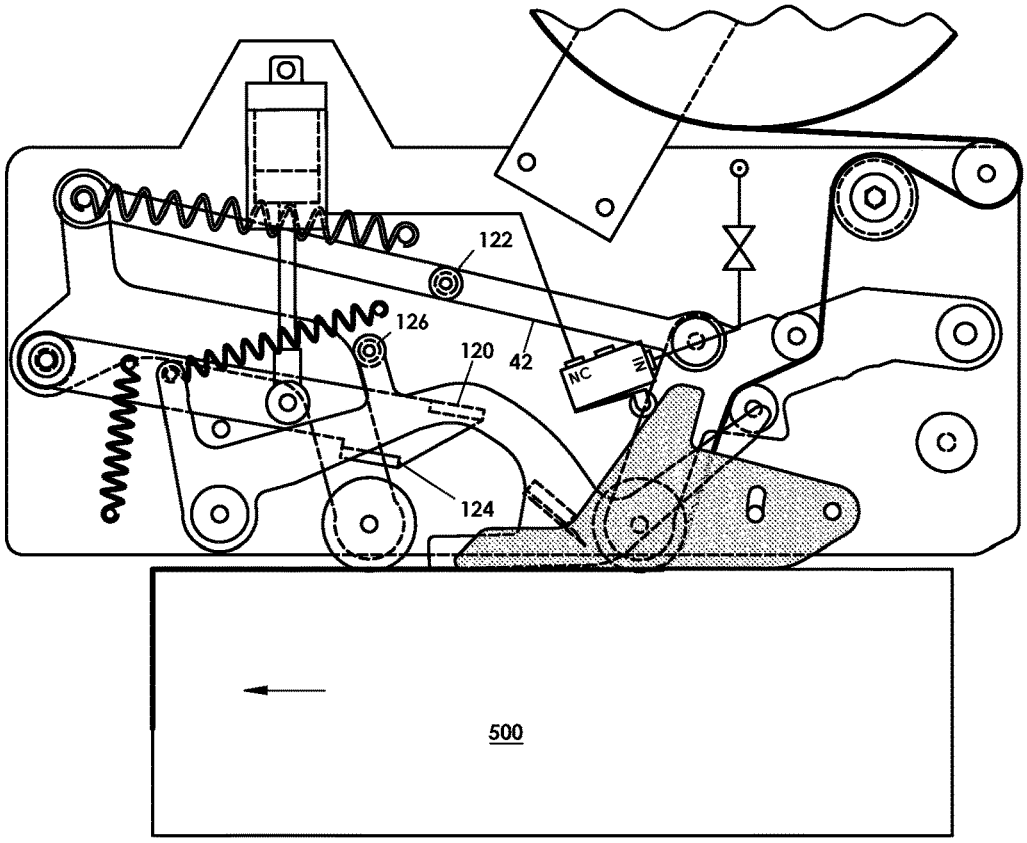
FIG. 7 is similar to FIG. 3 but with the supply of air turned off.

FIG. 7 which is similar to FIG. 3 but illustrates what happens if the air flow to the cylinder 104 is not provided i.e. valve 135 shuts off flow to the valve 136 and the head 10 acts in the normally manner with full pressure of the spring 60 and 74 being applied throughout the cycle in the normal way.

It will be apparent that the reciprocal operations of the activators 104 and 650E to move the lever 102 and their timing will be the same regardless of the embodiment of the invention.

Having described the invention, modifications will be evident to those skilled in the art without departing from the scope of the invention as defined in the appended claims.

We claim:

1. A tape applicator, comprising a frame, a source of tape mounted on said frame, a front applicator assembly including a front applicator to apply a leading end of a tape from said source to a leading face of a carton moving relative to said tape applicator pivotably mounted on said frame on a first pivotal axis, a rear wipe down arm assembly including a rear wipe down roll to wipe a tape applied to said carton along a trailing face of said carton remote from said leading face pivotably mounted on said frame on a second pivotal axis parallel to said first pivotal axis, a push bar link interconnecting said application roll assembly and said wipe down assembly for movement together to form a tape applicator assembly, a cut-off mechanism mounted on said frame on a third pivotal axis parallel to said first and second pivotal axes and positioned between said first and second axes, a cam arm pivotably mounted to said frame on a cam arm axis parallel to said third axis, an applicator cam element and a cut-off cam element fixed to said cam arm, a cooperating applicator cam element connected to said tape applicator assembly and a cooperating cut-off cam element connected to said cut-off mechanism, an actuator interconnecting said cam arm and said frame, a control system controlling power to said actuator to move said cam arm.

2. The tape applicator as defined in claim 1 where said cooperating applicator cam is mounted on said push bar link.

3. The applicator as defined in claim 2 wherein said control system includes a control cam positioned to sense the location of said leading and trailing faces.

4. The applicator as defined in claim 3 wherein said control cam is mounted on said frame.

5. The applicator as defined in claim 4 wherein said activator is a pneumatic pressure cylinder and said control system includes a control valve controlling flow of air to said cylinder.

6. The applicator as defined in claim 4 wherein said activator is an electric solenoid and said control system includes an electric controller controlling power to said solenoid.

7. The applicator as defined in claim 3 wherein said activator is a pneumatic pressure cylinder and said control system includes a control valve controlling flow of air to said cylinder.

8. The applicator as defined in claim 3 wherein said activator is an electric solenoid and said control system includes an electric controller controlling power to said solenoid.

9. The applicator as defined in claim 2 wherein said activator is a pneumatic pressure cylinder and said control system includes a control valve controlling flow of air to said cylinder.

10. The applicator as defined in claim 2 wherein said activator is an electric solenoid and said control system includes an electric controller controlling power to said solenoid.

11. The applicator as defined in claim 1 wherein said control system includes a control cam positioned to sense said leading and trailing faces.

12. The applicator as defined in claim 11 wherein said control cam is mounted on said frame.

13. The applicator as defined in claim 12 wherein said activator is a pneumatic pressure cylinder and said control system includes a control valve controlling flow of air to said cylinder.

14. The applicator as defined in claim 12 wherein said activator is an electric solenoid and said control system includes an electric controller controlling power to said solenoid.

15. The applicator as defined in claim 11 wherein said activator is a pneumatic pressure cylinder and said control system includes a control valve controlling flow of air to said cylinder.

16. The applicator as defined in claim 11 wherein said activator is an electric solenoid and said control system includes an electric controller controlling power to said solenoid.

17. The applicator as defined in claim 1 wherein said activator is a pneumatic pressure cylinder and said control system includes a control valve controlling flow of air to said cylinder.

18. The applicator as defined in claim 1 wherein said activator is an electric solenoid and said control system includes an electric controller controlling power to said solenoid.

* * * * *